US010221646B2

(12) United States Patent
Sedens et al.

(10) Patent No.: US 10,221,646 B2
(45) Date of Patent: Mar. 5, 2019

(54) ANTI-EXTRUSION RAM SEAL FOR BLOWOUT PREVENTER

(71) Applicant: Domino International SRL, St. Michael (BB)

(72) Inventors: Dietmar Sedens, Alberta (CA); Werner Harder, Alberta (CA)

(73) Assignee: Domino International SRL, St. Michael (BB)

( * ) Notice: Subject to any disclaimer, the term of this patent is extended or adjusted under 35 U.S.C. 154(b) by 0 days.

(21) Appl. No.: 15/305,922

(22) PCT Filed: Apr. 20, 2015

(86) PCT No.: PCT/IB2015/000533
§ 371 (c)(1),
(2) Date: Oct. 21, 2016

(87) PCT Pub. No.: WO2015/162482
PCT Pub. Date: Oct. 29, 2015

(65) Prior Publication Data

US 2017/0037695 A1 Feb. 9, 2017

(30) Foreign Application Priority Data

Apr. 23, 2014 (CA) ..... 2849688

(51) Int. Cl.
*E21B 33/06* (2006.01)

(52) U.S. Cl.
CPC ..... *E21B 33/061* (2013.01)

(58) Field of Classification Search
USPC ..... 251/1.1–1.3
See application file for complete search history.

(56) References Cited

U.S. PATENT DOCUMENTS 3,023,994 A * 3/1962 Gibson ..... E21B 33/062 251/1.3
3,554,480 A * 1/1971 Rowe ..... E21B 33/062 251/1.3
4,703,938 A 11/1987 Fox
4,986,511 A * 1/1991 Irby ..... E21B 33/06 251/1.1
5,127,623 A 7/1992 McDugle
5,294,088 A 3/1994 McWhorter et al.
7,255,329 B1 * 8/2007 Sedens ..... F16K 3/314 251/327
7,552,765 B2 * 6/2009 Lam ..... E21B 33/062 166/55

OTHER PUBLICATIONS

Written Opinion of the International Searching Authority, PCT/IB2015/000533, dated Jul. 10, 2015, 4 pages.

* cited by examiner

*Primary Examiner* — Robert K Arundale
*Assistant Examiner* — Daphne M Barry
(74) *Attorney, Agent, or Firm* — Taft Stettinius & Hollister LLP

(57) ABSTRACT

A polished rod BOP ram seal is formed with protrusions that are disposable in corresponding seal retention pockets formed in a seal-receiving groove in a BOP ram receiving the seal. The resultant mechanical interlock between the ram seal and the ram provides increased resistance to extrusion of the seal from the ram under high-pressure, high-velocity fluid flow conditions through the BOP.

9 Claims, 5 Drawing Sheets

ANTI-EXTRUSION RAM SEAL FOR BLOWOUT PREVENTER

FIELD OF THE DISCLOSURE

The present disclosure relates in general to blowout preventers (BOPs) for use in conjunction with producing oil wells, and relates in particular to seals for polished rod rams and blind rams incorporated into such BOPs.

BACKGROUND

Polished rod blowout preventers (rod BOPs) have been in use for oil and gas wells for over fifty years. Known types of rod BOPs have incorporated a variety of different ram designs, but they have typically included a large elastomeric seal section with a small steel insert to support it.

As working pressures at the wellhead increased, new rod BOP designs came into common use which had opposing rams made of steel, with each ram having a groove into which an elastomeric seal element could be installed. In such designs, the seal groove on each ram extends transversely across the inner end face of ram, axially along the side of the ram and then along a circular path around at least a portion of the circumference of the ram, thereby creating a seal between the rams and their respective bores, and also creating a seal between each set of opposing rams and the polished rod. The seals have a cross-section that is smaller than the grooves, thereby allowing them to be compressed into the grooves. This design provided enhanced sealing effectiveness at higher pressures, as compared with earlier polished rod BOP seal designs. One example of this type of ram seal for a rod BOP can be seen in Canadian Patent No. 2,716,430.

In recent years, however, the process of hydraulic fracturing (commonly referred to as "fraccing") has added a new consideration to design and performance criteria for polished rod BOPs. Wells are often situated in close proximity to each other, and during fraccing operations in subsurface formations penetrated by multiple and relatively closely-spaced wells, fluid communication between wells has become common. Due to such fluid communication, high operating pressures in one well can result in similarly high pressures undesirably developing in one or more adjacent wells, which may necessitate closure of the BOPs on those wells.

However, for wells having prior art BOPs of the type described above, when the rams with narrow grooves are closed, a problem occurs: as the aperture between the polished rod and the opposing rams gets smaller, the velocity of the wellbore fluid passing through the BOP increases rapidly. The resultant high fluid velocity causes displacement or "extrusion" of the seals out of their grooves in the rams, resulting in failure of the BOP at exactly the time when well control is most required.

For the foregoing reason, there is a need for improved polished rod blowout preventers that will function in conditions of concurrent high fluid pressure and high fluid velocity, while reducing or eliminating the risk of extrusion of the ram seals and resultant loss of BOP effectiveness.

BRIEF SUMMARY

The present disclosure teaches embodiments of a ram seal for polished rod BOPs in which extrusion of the ram seal from an associated BOP ram under high-pressure, high-velocity fluid flow conditions is resisted by forming the seal element with anti-extrusion protrusions that are disposable in corresponding seal retention pockets formed in a seal-receiving groove in the ram.

In a first aspect, the present disclosure teaches a seal element for use with a ram of a blowout preventer (BOP), with the seal element being made from a resilient material and comprising:

- a curved segment having first and second ends; and
- a generally rectangular flat segment having two generally parallel flat surfaces extending between two generally parallel side edges; a first end contiguous with the first end of the curved segment; and a second end contiguous with the second end of the curved segment;

such that the seal element is configured in the general shape of a "D", with the flat surfaces of the flat segment being parallel to the plane of the "D", and wherein the seal element is formed with one or more flat surfaces, with one or more protrusions projecting from at least one of the one or more flat surfaces.

The curved segment of the seal element may be of semi-circular configuration.

In certain embodiments, the flat segment of the seal element may be formed with a semi-circular recess, for receiving and sealing against the cylindrical surface of a polished rod.

In certain embodiments, one or more of the one or more protrusions may be provided in the form of elongate protrusions parallel to the side edges of the flat segment. In such embodiments, the elongate protrusion(s) may be semi-circular in cross-section.

In embodiments having protrusions projecting from both of the flat surfaces of the seal element, the position of at least one of the protrusions projecting from one flat surface may coincide with the position of a corresponding protrusion projecting from the other flat surface.

In a second aspect, the present disclosure teaches BOP rams adapted to receive seal elements in accordance with the aforesaid first aspect of the present disclosure. In one embodiment of a BOP ram in accordance with the present disclosure, the BOP ram has a cylindrical outer surface and a flat end face, plus a seal groove configured to receive a seal element in accordance with the aforesaid first aspect of the disclosure, with the seal groove being characterized by:

- an end face segment extending across the flat end face of the ram;
- axially-extending side segments extending along the cylindrical outer surface of the ram;
- a curved segment extending circumferentially around the cylindrical outer surface of the ram between the ends of the side segments; and
- one or more seal retention pockets, with each seal retention pocket being configured to receive one of the one or more protrusions projecting from the seal element.

BRIEF DESCRIPTION OF THE DRAWINGS

Embodiments will now be described with reference to the accompanying Figures, in which numerical references denote like parts, and in which.

DETAILED DESCRIPTION

Figure 1:
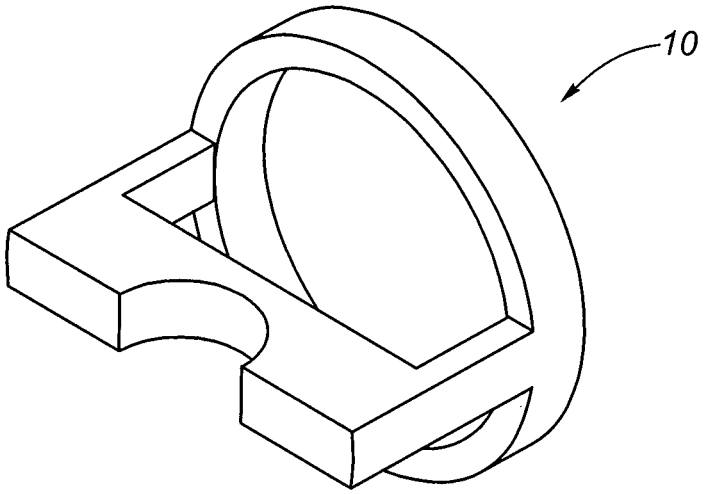
FIG. 1 (Prior Art)
FIG. 1 is an isometric view of a first prior art BOP ram seal for use with a polished rod BOP ram.
Figure 2A:
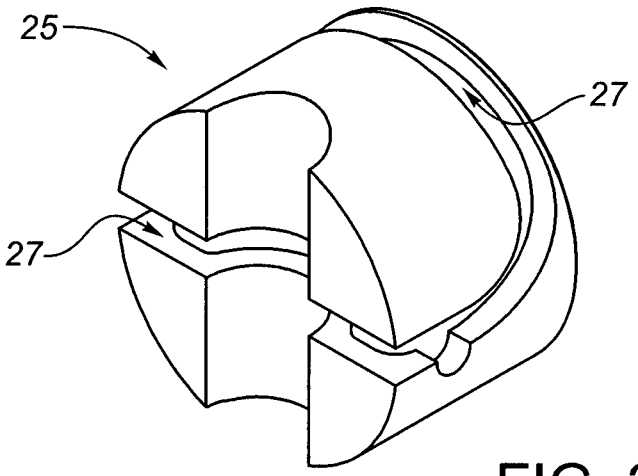
FIG. 2A (Prior Art)
FIG. 2A is an isometric view of a prior art BOP ram adapted to receive a ram seal as in FIG. 2.
Figure 2:
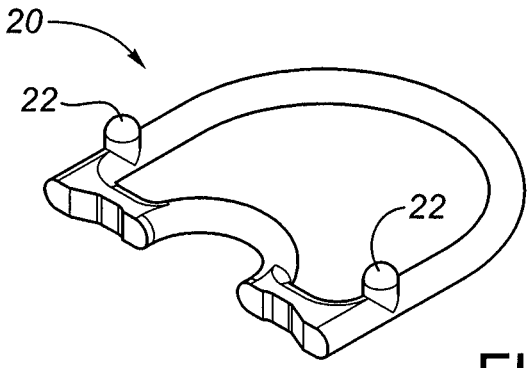
FIG. 2 (Prior Art)
FIG. 2 is an isometric view of a second prior art BOP ram seal for use with a polished rod BOP ram.
Figure 3A:
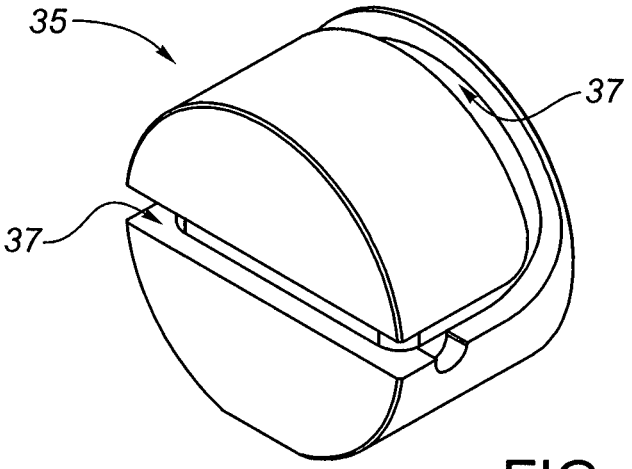
FIG. 3A (Prior Art)
FIG. 3A is an isometric view of a prior art BOP blind ram adapted to receive a BOP blind ram seal as in FIG. 3.
Figure 3:
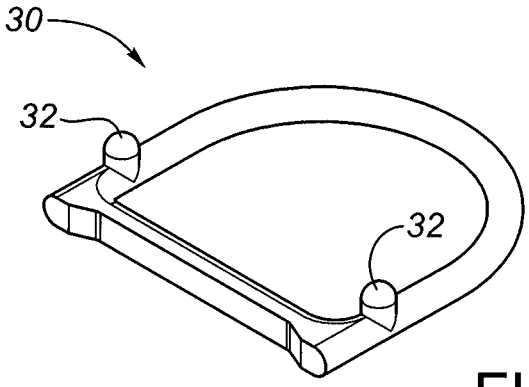
FIG. 3 (Prior Art)
FIG. 3 is an isometric view of a third prior art BOP ram seal similar to the ram seal in FIG. 2 but configured for use with a BOP blind ram.

FIGS. 1, 2, and 3 illustrate examples of prior art BOP ram seals. The prior art seal 10 in FIG. 1 is substantially similar to, for example, the seal illustrated in Canadian Patent No. 2,716,430. The prior art seal 20 in FIG. 2 and the prior art seal 30 in FIG. 3 are configured, respectively, for use with a polished rod BOP ram 25 as shown in FIG. 2A and a BOP blind ram 35 as shown in FIG. 3A. Prior art BOP rams as in FIGS. 2A and 3A, respectively, have seal grooves 27 and 37 for receiving prior art ram seals 20 and 30 respectively.

Prior art ram seals 20 and 30, respectively, include button-like projections 22 and 32 receivable in mating pockets in seal grooves 27 and 37 in BOP rams 25 and 35, respectively. These button-like projections are provided to counteract a tendency for seals 20 and 30 to "creep" out of seal grooves 27 and 37 in BOP rams 25 and 35 due to friction developing between the seals and their respective BOP ram bores, particularly when the seals are dry. These projections were found to be effective for that particular purpose, but not effective to prevent seal extrusion under high-pressure, high-velocity fluid flow conditions.

Figure 4A:
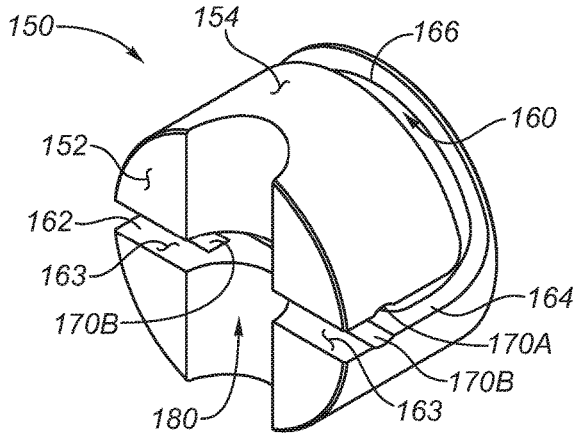
FIG. 4A is an isometric view of a rod BOP ram adapted to receive a rod BOP ram seal as in FIG. 4.
Figure 4:
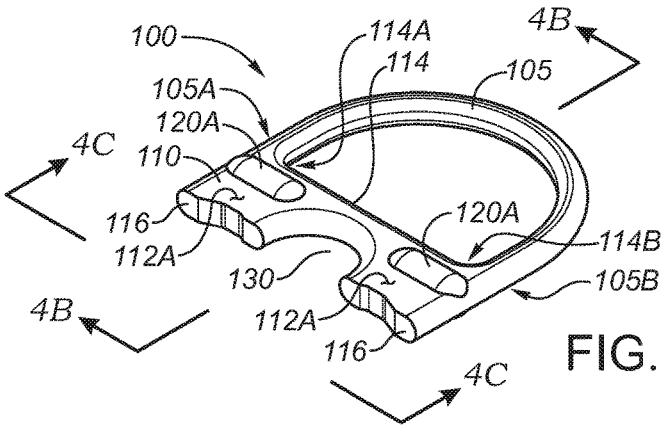
FIG. 4 is an isometric view of a first embodiment of a BOP ram seal in accordance with the present disclosure, configured for use with a polished rod BOP ram.
Figure 4B:
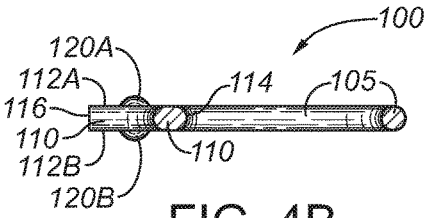
FIG. 4B is a cross-section through the rod BOP ram seal in FIG. 4.
Figure 4C:
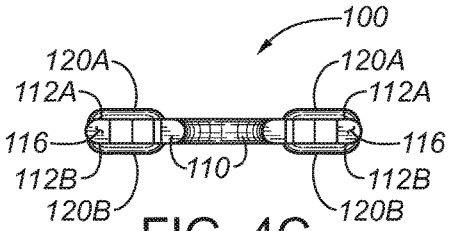
FIG. 4C is an edge view of the rod BOP ram seal in FIG. 4.

FIGS. 4, 4B, and 4C illustrate a first embodiment 100 of an "anti-extrusion" rod BOP ram seal element in accordance with the present disclosure, configured for use in conjunction with a polished rod BOP ram. Rod BOP ram seal 100 is configured in a general shape of the capital letter "D" (which can be characterized as having a curved component and a straight component). Seal 100 incorporates a curved (and typically semi-circular) segment 105 corresponding to a curved component of the D-shape of seal 100, and plus a flat segment 110 corresponding to a straight component (i.e., vertical leg) of the D-shape of seal 100. Flat segment 110 may be of rectangular configuration. In the illustrated embodiment, flat segment 110 has opposed and generally parallel first and second flat surfaces 112A and 112B, an inner side edge 114, and an outer side edge 116, with side edges 114 and 116 being generally parallel to each other. Inner side edge 114 extends between a first end region 114A and a second end region 114B. Curved segment 105 has a first end 105A which is contiguous with first end region 114A of inner side edge 114 of flat segment 110, plus a second end 105B which is contiguous with second end region 114B of inner side edge 114 of flat segment 110. A semi-cylindrical rod recess 130 is formed into flat segment 110 along outer side edge 116 to facilitate sealing against a polished rod.

In the illustrated embodiment, rod BOP ram seal 100 is formed with two "anti-extrusion" protrusions 120A projecting from first flat surface 112A, and two "anti-extrusion" protrusions 120B projecting from second flat surface 112B, for inhibiting displacement of BOP ram seal 100 from a BOP ram in which it has been installed. Preferably, the positions of the protrusions 120A on flat surface 112A will mirror the positions of protrusions 120B on flat surface 112B, as seen in FIGS. 4B and 4C. However, this is by way of preferred and non-limiting example only; alternative embodiments of rod BOP ram seal 100 may use different numbers and/or positional arrangements of protrusions 120A and 120B without departing from the scope of the present disclosure.

Preferably, protrusions 120A and 120B are of elongate configuration and are oriented generally parallel to side edges 114 and 116. However, protrusions 120A and 120B of other configurations or orientations may be used without departing from the intended scope of the present disclosure.

FIG. 4A illustrates a rod BOP ram 150 configured to receive a rod BOP ram seal 100 as illustrated in FIG. 4. Rod BOP ram 150 is generally cylindrical, with a cylindrical outer surface 154 and a flat end face 152 formed with a semi-cylindrical recess 180 for receiving a polished rod. Rod BOP ram 150 is formed with a continuous seal groove 160 comprising an end face groove segment 162 (extending across flat end face 152 and recess 180 therein), side groove segments 164 (extending in an axial direction along cylindrical outer surface 154), and a curved groove segment 166 (extending circumferentially around cylindrical outer surface 154 between the ends of side groove segments 164). When rod BOP ram seal 100 is installed on rod BOP ram 150, flat segment 110 of ram seal 100 will be disposed within end face groove segment 162 of seal groove 160 in rod BOP ram 150, and curved segment 105 will be disposed within side groove segments 164 and curved groove segment 166 of seal groove 160.

End face segment 162 of seal groove 160 has parallel flat groove surfaces 163 spaced to accommodate flat segment 110 of rod BOP ram seal 100. Appropriately configured seal retention pockets 170A and 170B are formed into flat groove surfaces 163 to receive protrusions 120A and 120B on ram seal 100.

Figure 5A:
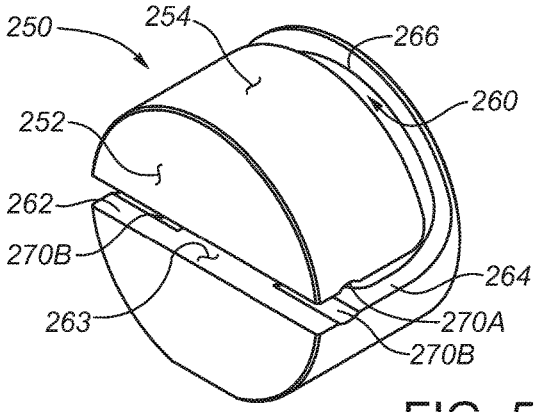
FIG. 5A is an isometric view of a BOP blind ram adapted to receive a BOP blind ram seal as in FIG. 5.
Figure 5:
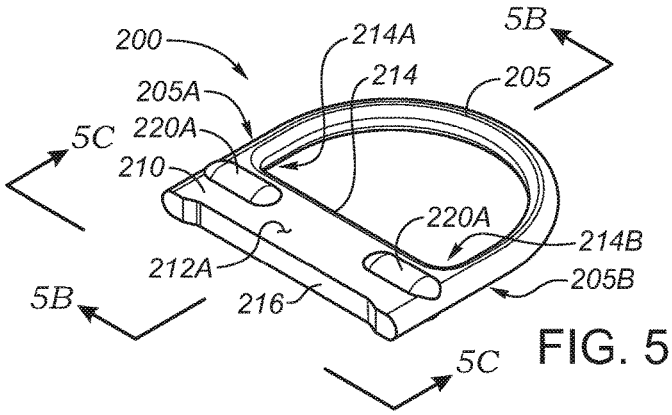
FIG. 5 is an isometric view of a second embodiment of a BOP ram seal in accordance with the present disclosure, configured for use with a BOP blind ram.
Figure 5B:
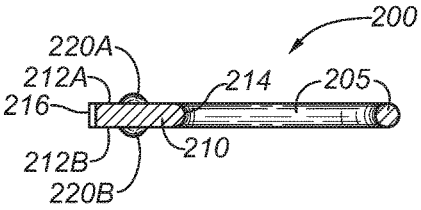
FIG. 5B is a cross-section through the BOP ram seal in FIG. 5.
Figure 5C:
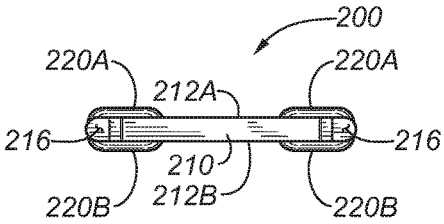
FIG. 5C is an edge view of the BOP ram seal in FIG. 5.

FIG. 5 illustrates a second embodiment 200 of an "anti-extrusion" BOP ram seal element in accordance with the present disclosure, configured for use in conjunction with a BOP blind ram. BOP blind ram seal 200 is configured in a general shape of the capital letter "D". Seal 200 incorporates a curved segment 205 corresponding to a curved component of the D-shape of seal 200, plus a flat segment 210 corresponding to a straight component of the D-shape of seal 200. Flat segment 210 may be of rectangular configuration. In the illustrated embodiment, flat segment 210 has opposed and generally first and second parallel flat surfaces 212A and 212B, an inner side edge 214, and an outer side edge 216, with side edges 214 and 216 being generally parallel to each other. Inner side edge 214 extends between a first end region 214A and a second end region 214B. Curved segment 205 has a first end 205A which is contiguous with first end region 214A of inner side edge 214 of flat segment 210, plus a second end 205B which is contiguous with second end region 214B of inner side edge 214 of flat segment 210. BOP blind ram seal 200 is preferably formed with two "anti-extrusion" protrusions 220A projecting from first flat surface 212A, and two "anti-extrusion" protrusions projecting from second flat surface 212B, as in the embodiment illustrated in FIGS. 5, 5B, and 5C.

BOP blind ram seal 200 is thus substantially similar to rod BOP ram seal 100 except that it does not have the rod recess 130 of rod BOP ram seal 100.

FIG. 5A illustrates a BOP blind ram 250 configured to receive a BOP blind ram seal 200 as illustrated in FIG. 5. BOP blind ram 250 is generally cylindrical, with a cylindrical outer surface 254 and a flat end face 252, and is formed with a continuous seal groove 260 comprising an end face groove segment 262, side groove segments 264, and a curved groove segment 266 extending circumferentially around cylindrical outer surface 254 between the ends of side groove segments 264. When BOP blind ram seal 200 is installed on BOP blind ram 250, flat segment 210 of ram seal 200 will be disposed within end face groove segment 262 of seal groove 260 in BOP blind ram 250, and curved segment 205 will be disposed within side groove segments 264 and curved groove segment 266 of seal groove 260.

End face segment 262 of seal groove 260 has parallel flat groove surfaces 263 spaced to accommodate flat segment 210 of BOP blind ram seal 200, with seal retention pockets 270A and 270B formed into flat groove surfaces 263 to receive protrusions 220A and 220B on ram seal 200.

BOP blind ram 250 is thus substantially similar to rod BOP ram 150 except that its end face 252 does not have the rod recess 180 of rod BOP ram 150.

It will be readily appreciated by those skilled in the art that various modifications to embodiments in accordance with the present disclosure may be devised without departing from the present teachings, including modifications which may use structures or materials later conceived or developed. It is to be especially understood that the scope of the claims appended hereto should not be limited by any particular embodiments described and illustrated herein, but should be given the broadest interpretation consistent with the disclosure as a whole. It is also to be understood that the substitution of a variant of a claimed element or feature, without any substantial resultant change in functionality, will not constitute a departure from the scope of the disclosure or claims.

In this patent document, any form of the word "comprise" is intended to be understood in a non-limiting sense, meaning that any item following such word is included, but items not specifically mentioned are not excluded. A reference to an element by the indefinite article "a" does not exclude the possibility that more than one such element is present, unless the context clearly requires that there be one and only one such element. Any use of any form of any term describing an interaction between elements is not meant to limit the interaction to direct interaction between the elements in question, but may also extend to indirect interaction between the elements such as through secondary or intermediary structure, without departing from the scope of the disclosure.

Relational or conformational terms such as but not limited to "circular", "cylindrical", "flat", and "parallel" are not intended to denote or require absolute mathematical or geometrical precision. Accordingly, such terms are to be understood as denoting or requiring substantial precision only (e.g., "substantially circular" or "generally parallel") unless the context clearly requires otherwise.

Any use of any form of the term "typical" is to be interpreted in the sense of being representative of common usage or practice, and is not to be interpreted as implying essentiality or invariability.

The embodiments of the invention in which an exclusive property or privilege is claimed are defined as follows:

1. A seal element for use in conjunction with a ram of a blowout preventer (BOP), said seal element being made from a resilient material and being configured in a general shape of the capital letter "D", said seal element comprising:
   (a) a curved segment corresponding to a curved element of the D-shape of the seal element, said curved segment having a first end and a second end; and
   (b) a flat segment corresponding to a straight component of the D-shape of the seal element, said flat segment having an inner side edge, an outer side edge, a first flat surface extending between the inner and outer side edges, and a second flat surface extending between the inner and outer side edges, said second flat surface being parallel to said first flat surface;

wherein:
   (c) the inner side edge of the flat segment has a first end region and a second end region;
   (d) the first end of the curved segment is contiguous with the first end region of the inner side edge of the flat segment;
   (e) the second end of the curved segment is contiguous with the second end region of the inner side edge of the flat segment; and
   (f) the seal element is formed with two or more protrusions projecting from the first flat surface of the flat segment, and with two or more protrusions projecting from the second flat surface of the flat segment.

2. A seal element as in claim 1 wherein the curved segment is of semi-circular configuration.

3. A seal element as in claim 1 wherein the flat segment is formed with a semi-circular recess, for receiving and sealing against a cylindrical surface of a polished rod.

4. A seal element as in claim 1 wherein at least one of the protrusions of the two or more protrusions projecting from the first flat surface or the two or more protrusions projecting from the second flat surface is an elongate protrusion parallel to the side edges of the flat segment.

5. A seal element as in claim 1 wherein at least one of the protrusions of the two or more protrusions projecting from the first flat surface or the two or more protrusions projecting from the second flat surface is semi-circular in cross-section.

6. A seal element as in claim 1 wherein the positions of the two or more protrusions projecting from the first flat surface of the flat segment coincide with the positions of corresponding protrusions projecting from the second flat surface of the flat segment.

7. A seal element as in claim 1 wherein the flat segment is of rectangular configuration.

8. A BOP ram having a cylindrical outer surface and a flat end face, and further having a seal groove configured to receive a seal element in accordance with claim 1, said seal groove being characterized by:
   (a) an end face segment extending across said flat end face, said end face segment having a first end and a second end;
   (b) a first side segment having an outer end and an inner end, said outer end of the first side segment being contiguous with the first end of the end face segment, and said first side segment extending axially from the first end of the end face segment along said cylindrical outer surface;
   (c) a second side segment having an outer end and an inner end, said outer end of the second side segment being contiguous with the second end of the end face segment, and said second side segment extending axially from the second end of the end face segment along the cylindrical outer surface;

(d) a curved segment extending circumferentially around said cylindrical outer surface between the inner ends of the first and second side segments; and (e) a plurality of seal retention pockets formed in the end face segment, said plurality of seal retention pockets corresponding in number to the two or more protrusions projecting from the first flat surface and the two or more protrusions projecting from the second flat surface, with each seal retention pocket being configured to receive one of said protrusions.

9. A BOP ram as in claim 8 further having a semi-cylindrical recess formed into the flat end face of the BOP ram and extending across the seal groove.

* * * * *